US008678733B2

(12) United States Patent
Thomas et al.

(10) Patent No.: US 8,678,733 B2
(45) Date of Patent: Mar. 25, 2014

(54) STRUCTURE FOR TRANSPORTING AND INSTALLING OR RETRIEVING UNDERWATER EQUIPMENT AND METHOD OF TRANSPORTING AND OF INSTALLING OR RETRIEVING UNDERWATER EQUIPMENT

(75) Inventors: Pierre-Armand Thomas, Puteaux (FR); Jean-Marc Cholley, Taverny (FR)

(73) Assignee: Technip France (FR)

( * ) Notice: Subject to any disclaimer, the term of this patent is extended or adjusted under 35 U.S.C. 154(b) by 452 days.

(21) Appl. No.: 12/997,275

(22) PCT Filed: Jun. 12, 2009

(86) PCT No.: PCT/FR2009/051110

§ 371 (c)(1),
(2), (4) Date: Feb. 25, 2011

(87) PCT Pub. No.: WO2009/150383

PCT Pub. Date: Dec. 17, 2009

(65) Prior Publication Data

US 2011/0150623 A1 Jun. 23, 2011

(30) Foreign Application Priority Data

Jun. 13, 2008 (FR) ..... 08 53933

(51) Int. Cl.
*B63B 35/00* (2006.01)
*B63B 9/06* (2006.01)
*B63B 35/44* (2006.01)

(52) U.S. Cl.
USPC ..... 414/137.3; 405/196; 405/219; 114/61.22; 114/265; 114/259

(58) Field of Classification Search
USPC ..... 114/258, 259, 260, 263, 264, 265, 266, 114/27, 283, 284, 352, 366, 377, 46, 50, 51, 114/61.1, 61.15, 61.18, 61.22; 212/273, 212/307; 254/89 H, 90; 294/74, 81.1, 81.5; 405/196, 201, 204, 3; 414/137.1, 414/137.2, 137.3, 137.5, 137.6, 137.7, 414/137.8, 137.9, 138.1–138.5, 138.8, 414/139.2, 142.6, 142.7, 201
See application file for complete search history.

(56) References Cited

U.S. PATENT DOCUMENTS 2,347,690 A * 5/1944 Kannenberg ..... 114/51
2,375,286 A * 5/1945 Creed ..... 114/265

(Continued)

FOREIGN PATENT DOCUMENTS

FR 2908733 A 5/2008
WO WO 2005/123499 A 12/2005

OTHER PUBLICATIONS

International Search Report dated Nov. 25, 2009, issued in corresponding international application No. PCT/FR2009/051110.

*Primary Examiner* — Gregory Adams
(74) *Attorney, Agent, or Firm* — Ostrolenk Faber LLP

(57) ABSTRACT

The structure (10) for transporting and installing or retrieving underwater equipment comprises a floating hull (11) equipped with legs (20) that can be moved vertically relative to the floating hull (11), a platform (60) carried by shuttles (30) each associated with a leg (20) and able to be moved vertically relative to the hull (11) by said legs (20), means of temporarily anchoring the equipment to the underside of the platform (60) and means (65, 66) of moving said equipment in the water between a first position pressed against the anchoring means and a second position away from said means.

12 Claims, 13 Drawing Sheets

(56) References Cited

U.S. PATENT DOCUMENTS

| | | | | |
|---|---|---|---|---|
| 2,650,558 | A * | 9/1953 | Nizery | 114/266 |
| 2,916,002 | A | 12/1959 | Hunsucker | |
| 3,361,274 | A * | 1/1968 | Goldman | 114/260 |
| 3,507,241 | A * | 4/1970 | Annibale et al. | 114/259 |
| 3,645,405 | A * | 2/1972 | Stiglich | 212/294 |
| 5,915,906 | A * | 6/1999 | Lucking et al. | 414/142.8 |
| 7,011,473 | B2 | 3/2006 | Tangen et al. | |
| 2003/0108392 | A1 * | 6/2003 | McCarthy et al. | 405/196 |
| 2005/0158125 | A1 * | 7/2005 | Thomas et al. | 405/203 |
| 2005/0220573 | A1 * | 10/2005 | Benedict et al. | 414/143.2 |
| 2008/0035327 | A1 | 2/2008 | Fowkes | |

* cited by examiner

STRUCTURE FOR TRANSPORTING AND INSTALLING OR RETRIEVING UNDERWATER EQUIPMENT AND METHOD OF TRANSPORTING AND OF INSTALLING OR RETRIEVING UNDERWATER EQUIPMENT

CROSS-REFERENCE TO RELATED APPLICATIONS

The present application is a 35 U.S.C. §§371 national phase conversion of PCT/FR2009/051110, filed Jun. 12, 2009, which claims priority of French Patent Application No. 0853933, filed Jun. 13, 2008, the contents of which are incorporated herein by reference. The PCT International Application was published in the French language.

BACKGROUND OF THE INVENTION

The present invention relates to a structure for transporting and installing or retrieving underwater equipment.

The invention also relates to a method for transporting and installing or retrieving underwater equipment using such a structure.

In the field of underwater deposit mining, such as oil or gas mining, for example, it is common to place equipment, such as distribution boxes, manifolds, or pumps or separators, on the sea bottom.

This type of heavy equipment is most often put in place using hoisting cranes arranged on handling vessels or offshore mining vessels.

To that end, the underwater equipment to be installed is brought close to the mining site by a floating barge or a transport vessel.

Using a crane carried by another vessel or barge, the equipment is lifted and lowered by the crane provided with a cable, then placed on the sea bottom.

This method, which is the method most commonly used, has drawbacks.

The first drawback lies in the capacity of the hoisting cranes, which in some cases requires the addition of controllable buoyancy modules under the underwater equipment to be placed on the sea bottom in order to reduce the tension on the lowering cable.

The second drawback lies in the fact that during lifting of the equipment from the vessel or the transport barge, the equipment is suspended from a cable above the water level. When the equipment is lowered towards the bottom of the water, it will pass below the level of the water.

If the surface of the water is choppy, the equipment will undergo significant movements when the water level is broken, and these movements will be directly passed on to the cable supported by the crane.

These movements cause successive tensions and releases in said cable, as well as in the support means for the cable.

Also known is a method described in document U.S. Pat. No. 7,011,473 that consists of towing the underwater equipment to its installation site below the surface of the water with the aid of a vessel and maintaining the equipment using a buoy situated on the surface of the water.

However, towing the underwater equipment below the surface of the water poses safety problems and the equipment is suspended from a buoy when it is towed, said buoy being subjected to the various motions of the swell on the surface of the water.

Another method described in application US 2008/0035327 consists of placing the underwater equipment in a support frame and fastening said frame carrying the underwater equipment to the bottom of a transport barge.

At the installation site, the support frame and underwater equipment assembly is lowered using a drawworks, and said equipment is positioned on the sea bottom and disconnected from the support frame. Then, the support frame is raised below the hull of the barge.

The main drawback of this method lies in the towing of the underwater equipment below the water level to the installation site.

SUMMARY OF THE INVENTION

The invention aims to avoid these drawbacks by proposing a structure that allows, using means that are easy to implement, the transport and installation or retrieval of underwater equipment.

The invention therefore relates to a structure for transporting and installing or retrieving underwater equipment, characterized in that it includes:

- a floating hull equipped with legs that can be moved vertically relative to the floating hull using movement mechanisms,
- a platform carried by shuttles each associated with a leg and able to be moved vertically relative to the hull by said legs, each shuttle being provided with means for locking on the corresponding leg,
- means of temporarily anchoring the equipment to the underside of the platform, and
- means of moving said equipment in the water between a first position pressed against the anchoring means and a second position away from said means.

According to other features of the invention:

- the floating hull is U-shaped,
- the U-shaped floating hull has two opposite and parallel lateral arms, each carrying at least one leg and connected to each other by a central arm,
- the two lateral arms are formed by two floats and the central arm is formed by a cross-beam carried by said lateral arms and slidingly movable on said beam depending on the length of the platform carried by the shuttles,
- the movement means in the water comprises a bridge crane supported by the platform and including at least one support cable passing through said platform through an opening and provided, at its free end, with a hooking member for hooking on said equipment,
- the temporary anchoring means comprise, on one hand, at least two substantially vertical columns, carried by the platform and provided at their lower ends with positioning means for positioning said equipment and, on the other hand, tensioning and hooking means to said cable of the bridge crane,
- the positioning means comprise a hollow portion with a substantially conical shape, arranged at the lower portion of each column and substantially conical protruding portions, arranged on the equipment and each intended to cooperate with a hollow portion,
- each hollow portion is covered with a flexible material, such as an elastomer, for example,
- the tensioning and hooking means comprise at least two towing chains including a first end connected to the equipment and a second end connected to said cable of the bridge crane by a chain capable of cooperating with a locking element tensioned on the platform,
- said at least two columns can be slidingly moved below the platform in a direction substantially parallel to the lateral arms of the hull, the platform includes means for adjusting the spacing of said at least two columns in a direction parallel to the longitudinal axis of the hull and in a direction perpendicular to said longitudinal axis, the vertical positioning of each column relative to the platform can be adjusted, and the temporary fastening means comprise at least one clamp or at least one jaw or at least one explosive bolt.

The invention also relates to a method for transporting and installing underwater equipment using a structure as previously described, characterized in that it comprises the following steps:

bringing the underwater equipment near the hull of the structure by a floating transport element, lowering the legs relative to the hull, locking the shuttles carrying the platform on the legs, raising the legs with the shuttles and the platform, placing the platform above the underwater equipment, lowering the shuttles and the platform by the legs to bring the anchoring means into contact with the underwater equipment, locking the anchoring means to the underwater equipment, raising the shuttles and the platform carrying the underwater equipment by the legs, moving the structure to the installation site of the underwater equipment with said equipment above the water level, connecting the cable of the bridge crane to the underwater equipment, lowering the shuttles and the platform by the legs until the underwater equipment passes under the water level, tensioning the cable of the bridge crane, unlocking the anchoring means from the underwater equipment, and lowering the underwater equipment with the bridge crane cable to the sea bottom and disconnecting and raising the cable.

The invention also relates to a method for retrieving and transporting underwater equipment using a structure as previously defined, characterized in that it comprises the following steps:

moving the structure to the retrieval site of the equipment placed on the sea bottom, lowering the shuttles locked on said legs and the platform by the legs to bring the anchoring means below the water level, lowering the cable of the bridge crane into the water and connecting said cable to the underwater equipment, raising the equipment by the cable up to the anchoring means in the water, locking the anchoring means to the underwater equipment, raising the legs with the shuttles and the platform carrying the underwater equipment, to place said underwater equipment above the water level, moving the structure to a transport element and placing the underwater equipment above the transport element, lowering the shuttles and the platform carrying the underwater equipment by the legs, placing the underwater equipment on the transport element by lowering the legs, disconnecting the cable from the underwater equipment, raising the shuttles and the platform by the legs, and discharging the transport element carrying the underwater equipment from the structure.

BRIEF DESCRIPTION OF THE DRAWINGS

The invention will be better understood upon reading the following description, provided solely as an example and done in reference to the appended drawings, in which:

FIGS. 1 to 3 diagrammatically show a structure 10 intended for transporting and installing or retrieving underwater equipment such as distribution boxes, manifolds, pumps or separators, for example, or any other underwater equipment, e.g. for mining underwater deposits, such as oil or gas mining, for example.

DETAILED DESCRIPTION OF THE INVENTION

In the figures, the general dimensions of the structure 10 as well as the proportions between the different elements making up that structure have not necessarily been respected so as to simplify understanding of the drawings.

Generally, the structure 10 comprises a U-shaped floating hull 11 having two parallel and opposite lateral arms 11*a* connected to each other by a central arm 11*b*.

The two lateral arms 11*a* are formed by two floats extending parallel to each other and forming a free space between them, and the central arm 11*b* is formed by a cross-beam 11*c* carried by said lateral arms 11*a*.

Preferably, the cross-beam 11*c* forming the central arm is formed by a mesh of tubes connected to each other by longitudinal elements.

The lateral arms 11*a* of the structure 10 can be moved slidingly relative to each other on the cross-beam 11*c* so as to adjust their spacing, as will be seen later.

To that end, the float of each lateral arm 11*a* includes movement means 13 for movement on the cross-beam 11*c* for example formed by an assembly including guide rails and a rack-and-pinion system, not shown, and of a known type.

Moreover, the float of each lateral arm 11*a* is equipped with locking means, not shown, for locking on the cross-beam 11*c* so as to keep the spacing between these lateral arms 11*a* constant and determined.

Figure 1:
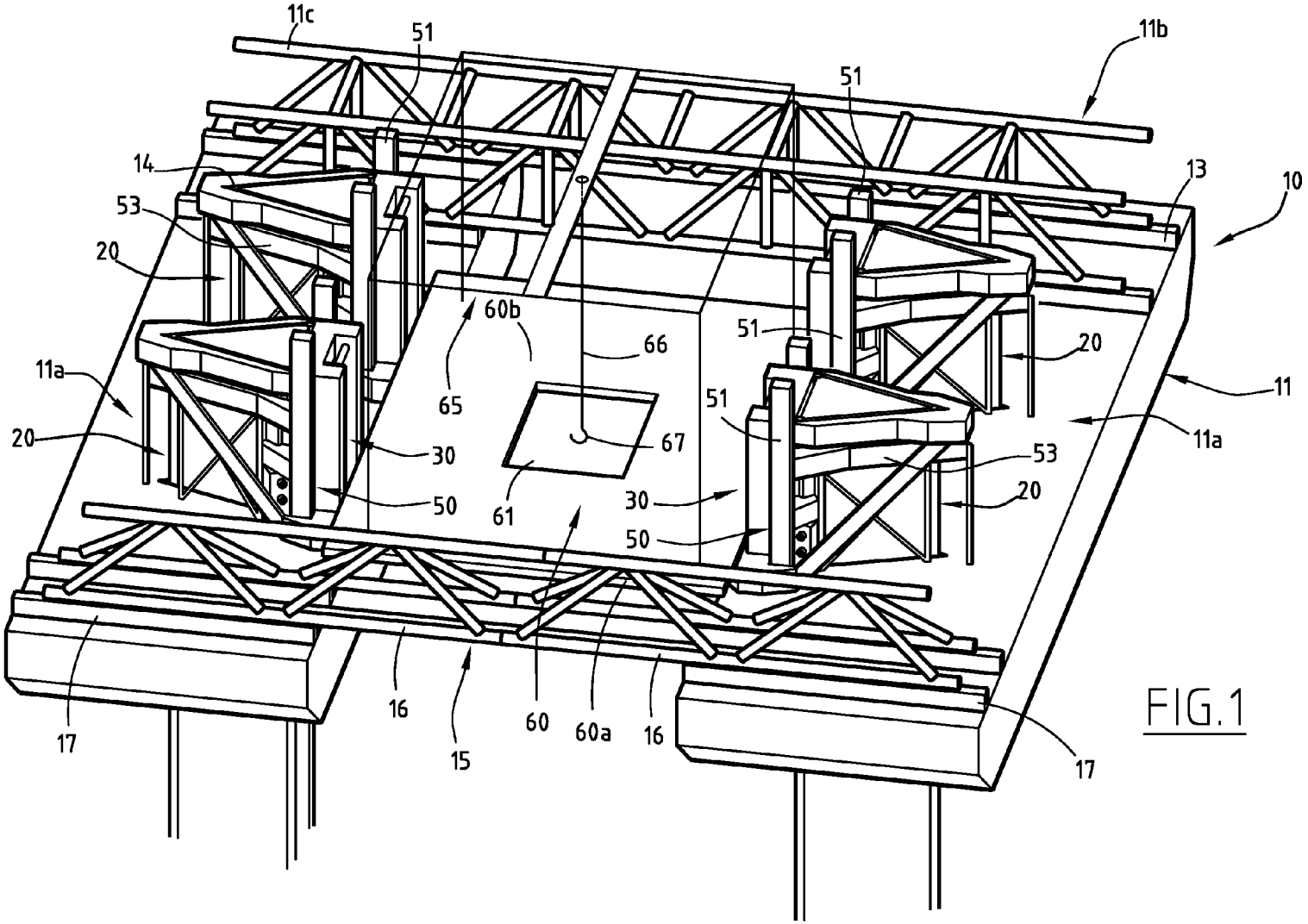
FIG. 1 is a diagrammatic perspective view of a transport, installation or retrieval structure, according to the invention.
Figure 2:
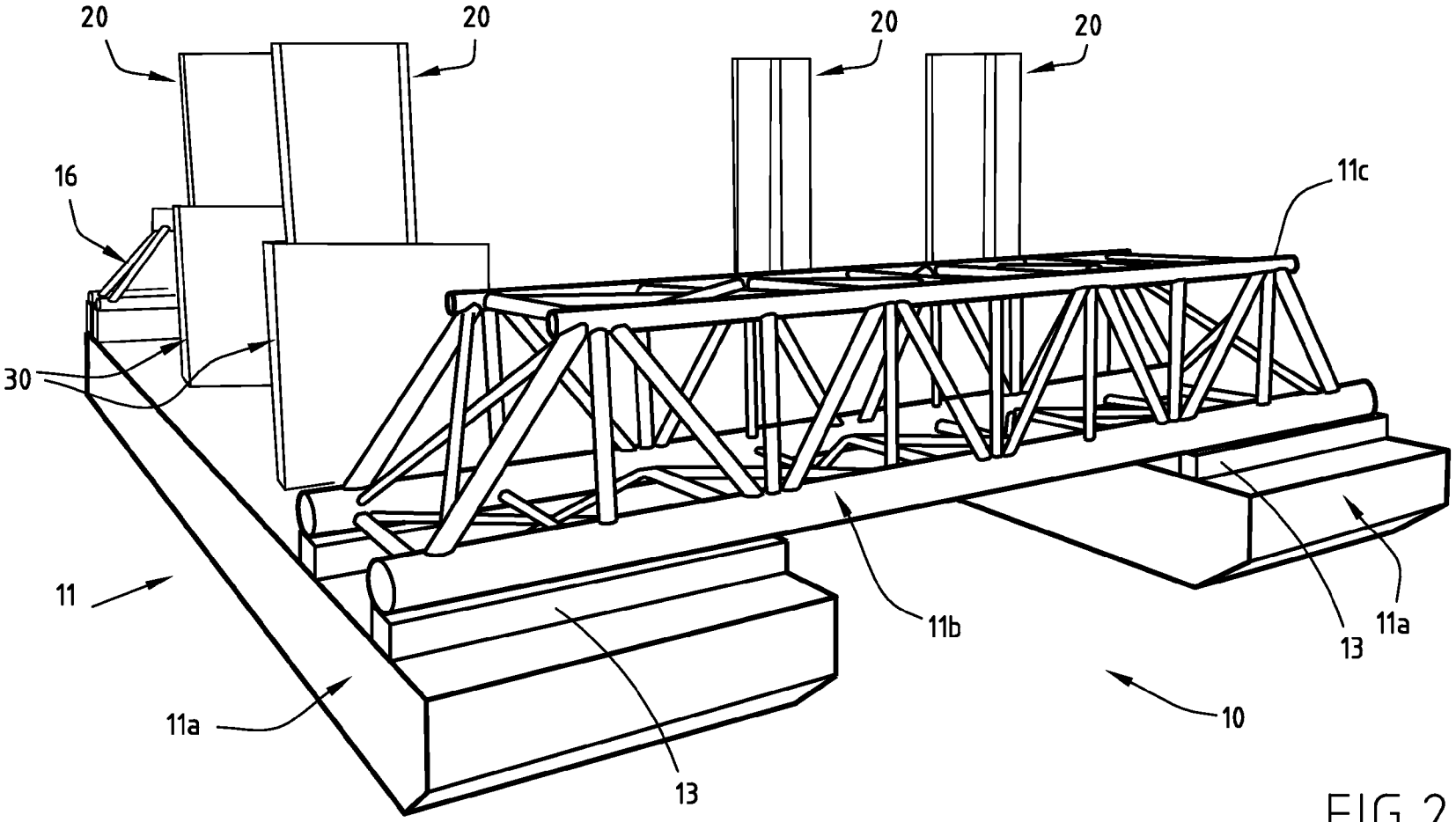
FIG. 2 is a diagrammatic perspective view of the back portion of the structure, according to the invention.
Figure 3:
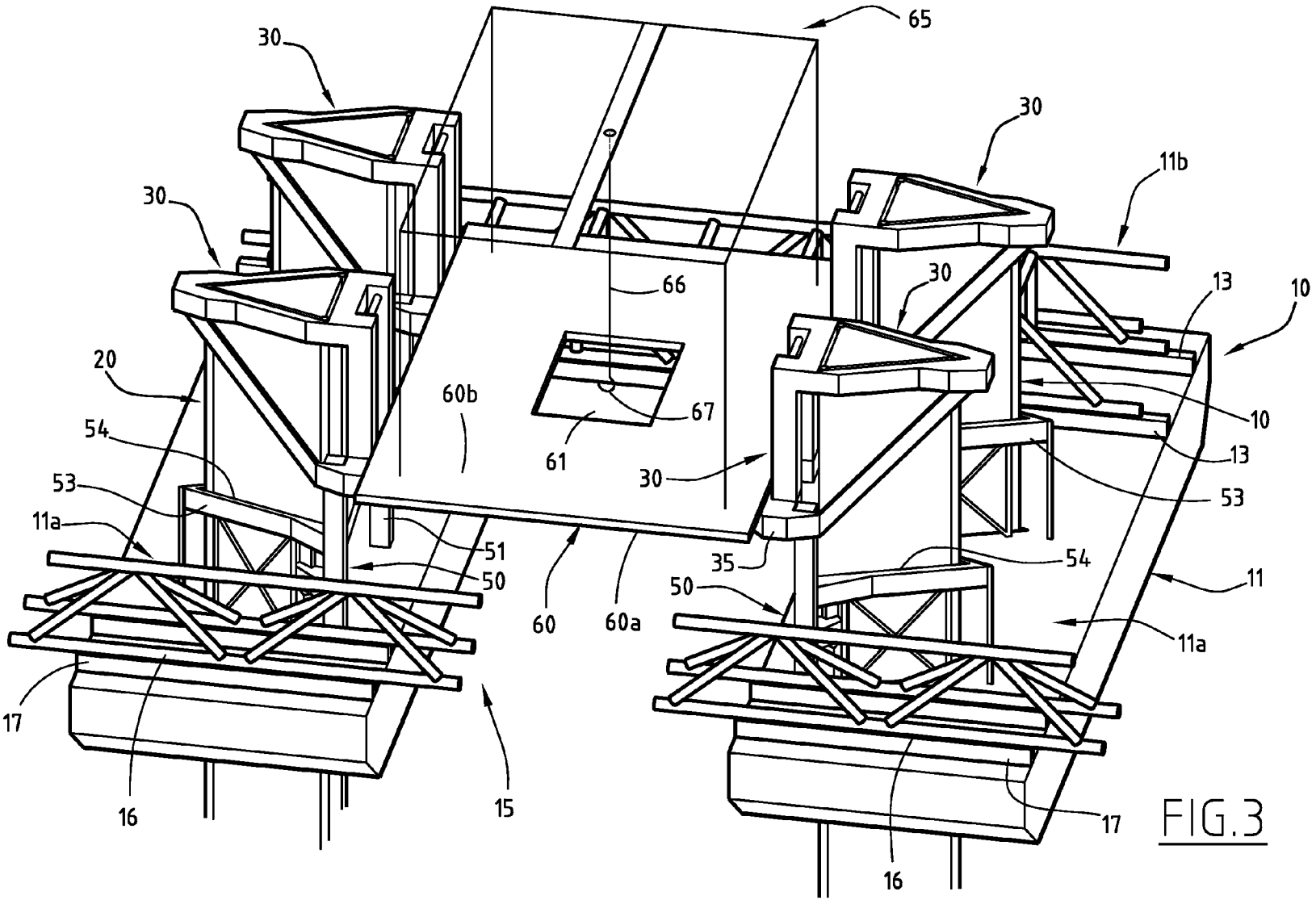
FIG. 3 is a diagrammatic perspective view of the structure with the platform carried by the shuttles in the high position.

As shown in FIGS. 1 and 3, the hull 11 includes, at its open portion, i.e. opposite the central arm 11*b*, a door globally designated by reference 15.

This door 15 is formed by two opposite beam segments 16 that can each be slidingly moved on a lateral arm 11*a*.

The two beam segments 16 can be moved between a separated position, as shown in FIG. 3, in which they free the inlet of the structure 10 for positioning a vessel or a barge, and a closed position of said inlet of the structure 10, as shown in FIG. 1, in which they are closer together and in contact with each other.

To that end, each lateral arm 11*a* of the hull 11 includes movement means 17 for moving each beam segment 16. These means 17 are for example formed by an assembly, not shown, including guide rails and a rack-and-pinion system or by any other known means and locking systems, not shown, between the beams.

Lastly, each lateral arm 11*a* also includes locking means, not shown, for locking the corresponding beam segment 16 in the closed position or in the open position.

The hull 11 is equipped with legs 20 that are vertically movable relative to said buoyant hull 11. In the embodiment shown in the figures, the hull 11 is equipped with four legs 20 arranged in pairs on each lateral leg 11*a* of the hull 11.

Each of the legs 20 for example has a triangular section as shown in the figures, or a square or circular section.

Figure 6:
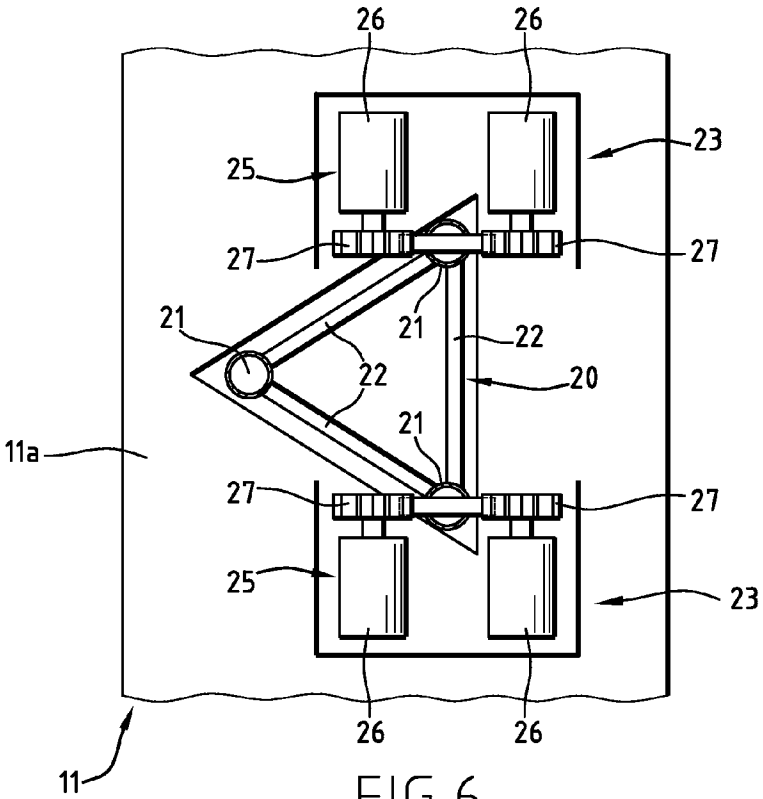
FIG. 6 is a cross-sectional view along line 6-6 of FIG. 5.
Figure 5:
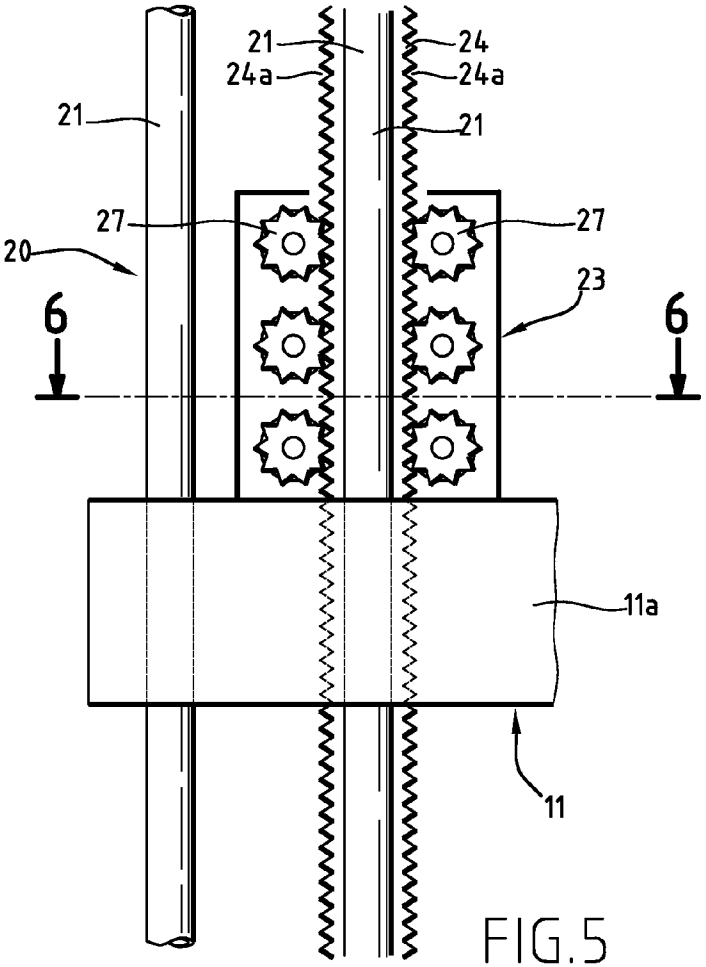
FIG. 5 is a partial vertical cross-sectional view of a mechanical means for moving a leg of the structure.

As shown in particular in FIGS. 5 and 6, each leg 20 is formed, traditionally, by three flanges 21 connected to each other by a mesh of metal beams 22. Each leg 20 is associated with mechanical movement means designated by general reference 23.

The mechanical movement means 23 are housed in a supporting framework also called a "jack house," which is supported by the hull 11.

As shown in FIGS. 5 and 6, the mechanical movement means 23 of each leg 20 comprise, on one hand, two opposite plates 24 each carried by a flange 21 of the corresponding leg 20 and including, each on each lateral face, a series of teeth 24*a* forming a double rack on the two flanges 21.

The mechanical movement means 23 also comprise several assemblies 25 distributed on either side of each plate 24, following the height thereof. Each assembly 25 comprises a gear motor 26 ensuring the driving of a pinion 27 that meshes with a series of teeth 24*a* of the corresponding plate 24.

In the embodiment shown in FIGS. 5 and 6, the two series of teeth 24*a* of each plate 24 are associated with six pinions 27 each driven in rotation by a gear motor group 26.

The structure 10 also includes, associated with each of the legs 20, a shuttle designated by general reference 30, which can be moved by the corresponding leg 20 between a low position bearing on the buoyant hull 11, as shown in FIG. 1, and a high position as shown in FIG. 3.

The shuttles 30 associated with the legs 20 can be moved simultaneously by the legs 20.

Figure 4:
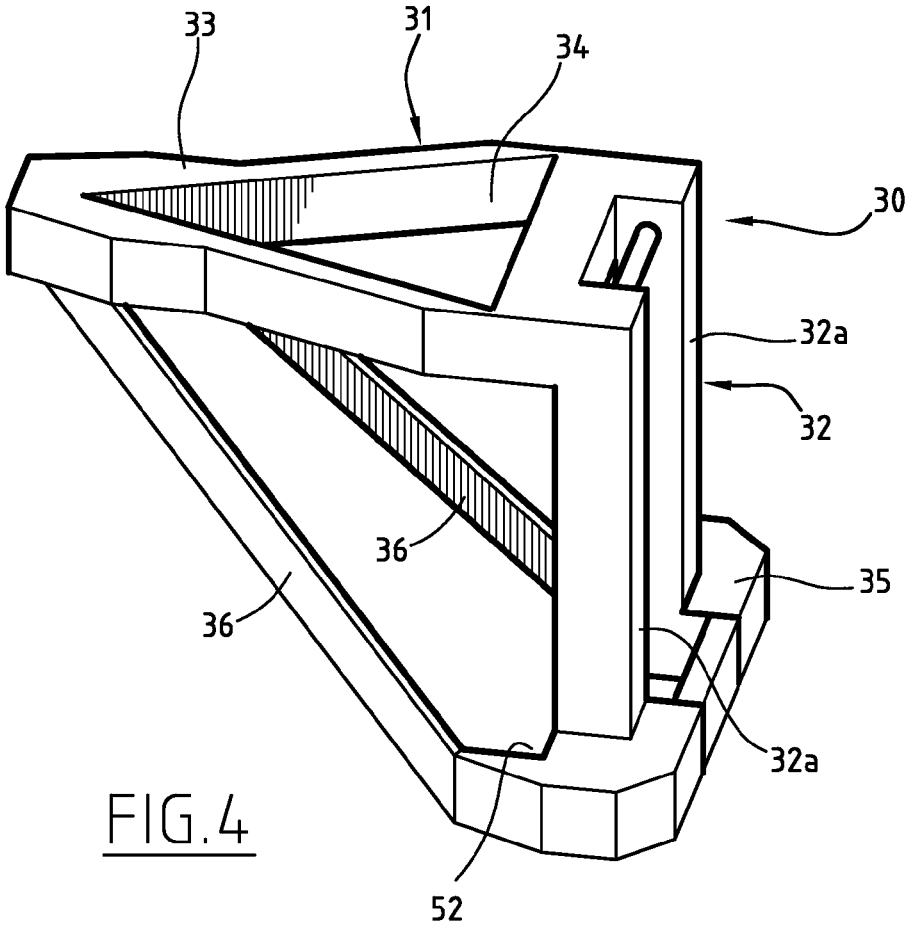
FIG. 4 is a diagrammatic perspective view of a shuttle of the structure.

In the embodiment shown in FIG. 4, each shuttle 30 is formed by a body 31 including a vertical arm 32 extending substantially parallel to the flanges 21 of the corresponding leg.

The vertical arm 32 is formed by two parallel vertical beams 32*a*.

The arm 32 is provided, on one hand, in its upper portion, with a plate 33 extending substantially perpendicular to said arm 32 and, on the other hand, in its lower portion, with a horizontal base plate 35 supporting a platform globally designated by reference 60 (FIG. 1), and which will be described later.

The plate 33 includes an opening 34 having a section with a shape complementary to the transverse section of the corresponding leg 20 and, in the present case, a triangular section. The plate 33 is connected to the base plate 35 by stiffening beams 36.

Each shuttle 30 is provided with locking means 40 for locking on the corresponding leg 12.

Figure 7:
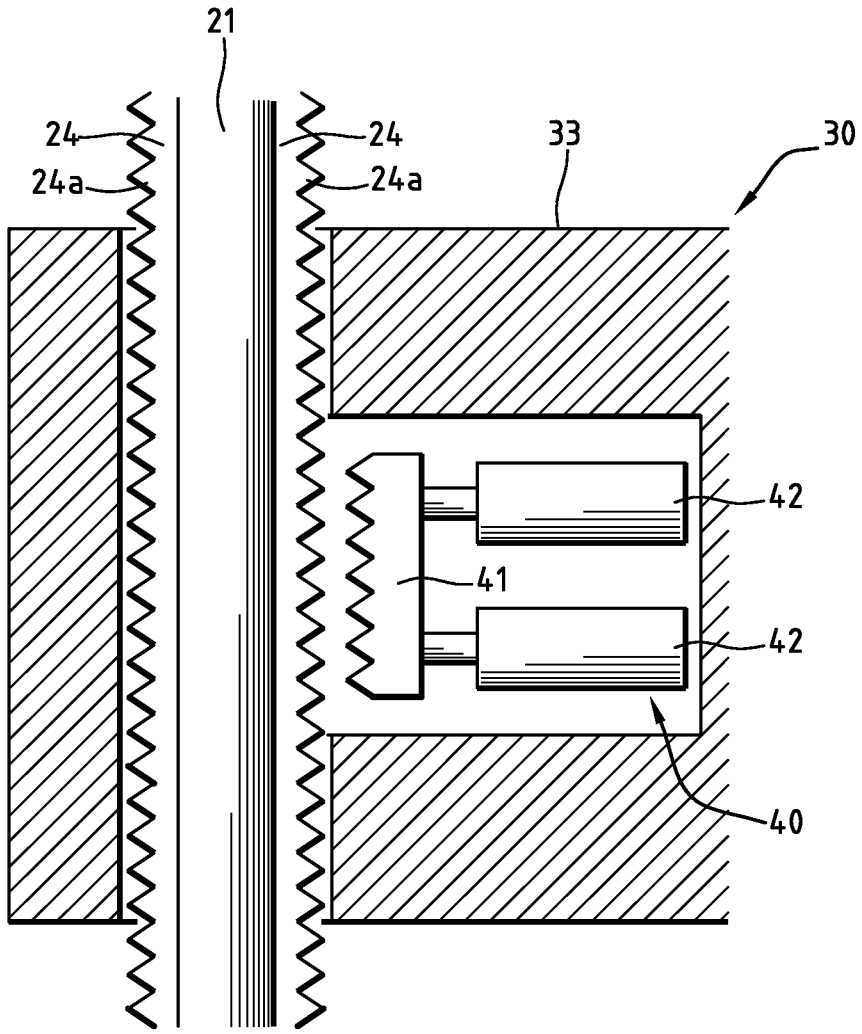
FIG. 7 is a diagrammatic vertical cross-sectional view of the locking means for locking a shuttle on a leg of the structure, according to the invention.

These locking means 40, shown in more detail in FIG. 7, are formed by at least one counter-rack 41 and, preferably, by at least one counter-rack 41 for each plate 24.

The counter-rack 41 can be moved by at least one actuating member 42 and, preferably, by two actuating members 42 for example made up of hydraulic or pneumatic jacks so as to move the counter-rack 41 between a retracted position and a locking position engaged on one of the series of teeth 24*a* of the corresponding leg 20.

The assembly formed by the counter-rack 41 and the actuating members 42 is carried by the plate 33 of each shuttle 30.

The hull 11 also includes, at each leg 20, guide means 50 for guiding the corresponding shuttle 30 between the low (FIG. 1) and high (FIG. 3) positions, respectively.

As shown in these FIGS. 1 and 3, the guide means 50 of the shuttle 30 of each leg 20 comprise two vertical columns 51 extending substantially parallel to the corresponding leg 20. Each column 51 cooperates with a passage 52 formed in the base plate 35 of the shuttle 30 and each of said passages 52 has a section shaped to match the section of the corresponding column 51. The two columns 51 are connected to each other by a connecting plate 53 extending substantially perpendicularly to said columns 51 that include includes a central passage 54 (FIG. 4) having a cross-section with a shape complementary to the transverse section of the corresponding leg 20 and, in the present case, a triangular section. The connecting plate 53 forms a guide for the corresponding leg 20.

During the movement of the shuttle 30 between the low position and the high position, by the leg 20, the base plate 35 of the shuttle 30 is guided by the columns 51, and in the high position shown in FIG. 1, the base plate 35 of the shuttle 30 bears on the upper end of each column 51.

For transporting and installing or retrieving underwater equipment 1, such as a distribution box, a manifold, a pump or a separator, for example, the structure 10 includes a platform 60 carried by the shuttles 30 each associated with a leg 20.

As shown in particular in FIG. 1, the platform 60 includes a central opening 61 that can for example be covered by two pivoting panels, not shown.

Generally, the structure 10 also includes:

anchoring means for temporary anchoring of the underwater equipment 1 on the underside 60*a* of the platform 60, and movement means for moving said underwater equipment 1 in the water between a first position pressed against the anchoring means and a second position away from the anchoring means.

The movement means diagrammatically illustrated in FIG. 1 comprises a bridge crane 65 supported by the platform 60 and including at least one support cable 66 passing through said platform 60 through the opening 61. The cable 66 is provided, at its free end, with a hooking member 67 for hooking on the equipment 1. The bridge crane 65 makes it possible to move the cable 66 parallel to the lateral arms 11*a* of the hull 11 or perpendicularly to said lateral arms 11*a*. The bridge crane 65 can include several hooking cables 66 for the equipment 1.

The movement means can be made up of any other suitable system.

Figure 8:
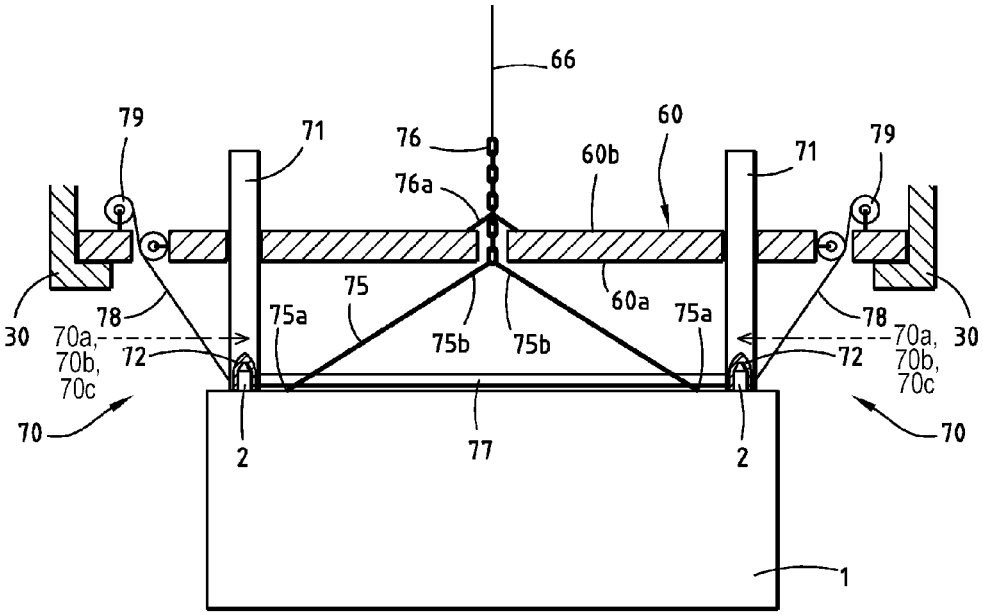
FIG. 8 is a diagrammatic elevation view of an embodiment of the anchoring means for anchoring underwater equipment below the platform of the structure, according to the invention.

FIG. 8 diagrammatically illustrates one preferred embodiment of the anchoring means for temporary anchoring of the underwater equipment 1 below the platform 60.

These anchoring means, designated by general reference 70, comprise at least two rigid columns 71, and preferably four substantially vertical columns 71 carried by the platform 60.

The four columns 71 are uniformly distributed in a square or rectangle.

The height of the columns 71 can be adjusted so that the underwater equipment 1 is below the surface of the water when the shuttles 30 carrying the platform 60 are in the low position.

The columns 71 can be moved by sliding by suitable means of a known type, below the platform 60 in a direction substantially parallel to the lateral arms 11*a* of the hull 11 as a function of the dimensions of the underwater equipment 1 to be transported.

Moreover, the columns 71 can be vertically movable and locked to the platform 60 using suitable means, of a known type and not shown, with the aim of adjusting their length so that the free ends of these columns 71 pass below the surface of the water in the low position of the shuttles 30.

According to the embodiment shown in FIG. 8, each column 71 is provided, at its lower end, with positioning means for positioning the underwater equipment 1 formed by a hollow portion 72 and by protruding portions 2 with a substantially conical complementary shape, formed on the equipment 1 and intended each to cooperate with a hollow portion 72.

Each hollow portion 72 is covered with a flexible material, such as an elastomer, for example.

The anchoring means 70 also comprise tensioning and hooking means of the cable 66 of the bridge crane 65.

These tensioning and hooking means for example comprise at least two towing chains 75 including a first end 75*a* connected to the equipment 1 and a second end 75*b* connected to the cable 66 by a chain 76 capable of cooperating with a locking member 76*a* tensioned on the platform 60. To stabilize the underwater element 1 below the platform 60, the lower ends of the columns 71 are connected by a cross-beam 77 and the lower ends of the columns 71 are also connected to the platform 60 by tensioning systems, such as a cable or a chain 78 drawn by a drawworks 79 carried by the platform 60.

According to other embodiments, the anchoring means for temporary anchoring of the underwater equipment 1 below the platform 60 can also be formed by at least one jaw 70*a*, or at least one clamp 70*b*, or at least one explosive bolt 70*c*, (see FIG. 8), situated at the lower ends of each column 71. In this case, the locking element 76*a* is not necessary. When the underwater equipment 1 is separated from the platform 60, the opening of the jaws or clamps or the explosion of the bolts must be simultaneous.

The transport and installation of underwater equipment 1 by the structure 10 to and on an exploitation site is done as follows.

Figure 9:
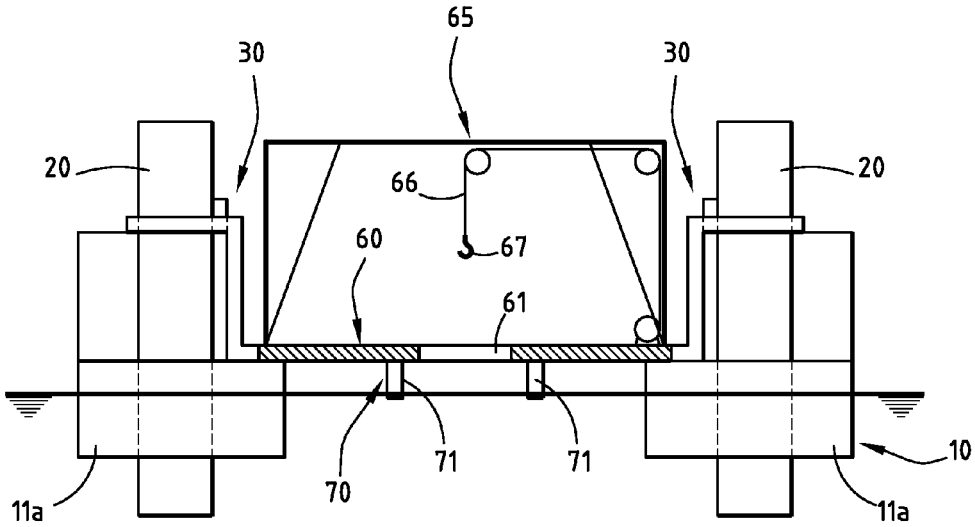
FIGS. 9 to 16 are diagrams showing the different steps of transporting and installing underwater equipment using the structure, according to the invention.

The structure 10 is buoyantly brought to a retrieval zone of the underwater equipment 1, with the shuttles 30 and the platform 60 in the low position, i.e. pressed against the lateral arms 11*a* of the hull 11, as shown in FIG. 9, and the legs 20 are lowered.

In that position, the shuttles 30 are locked on the legs 20. The locking of the shuttles 30 on the legs 20 is done by actuating the jacks 42 so that the counter-racks 41 engage with the adjacent teeth 24*a* or by a set of small beams situated on the upper portion of the shuttle 30 that are slidingly moved towards the inside of the shuttle 30 and the leg 20, which makes it possible to raise the leg 20 upwards to drive the corresponding shuttle 30.

The platform 60 is raised via shuttles 30 and legs 20, the hull 11 of the structure 10 remaining buoyant.

Figure 10:
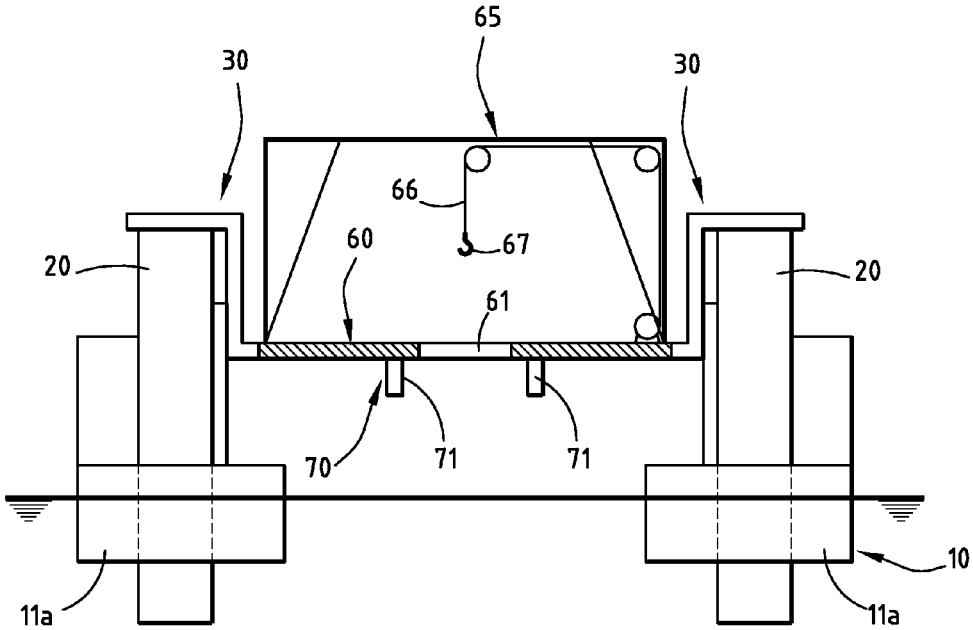
Figure 11:
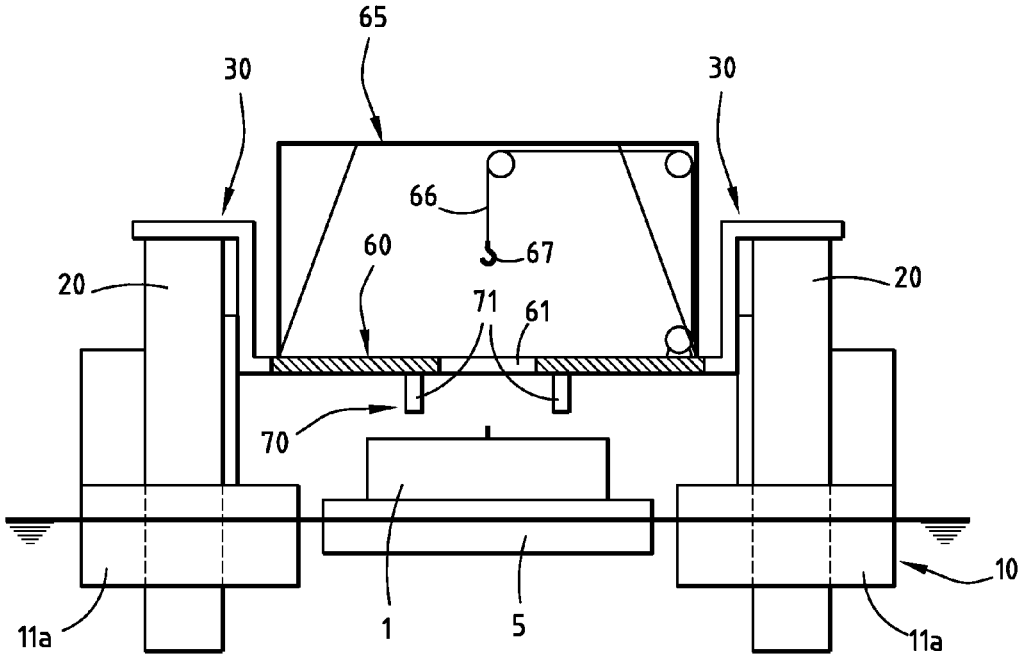

To that end, the gear motor groups 26 are actuated to drive the pinions 27 that mesh with the series of teeth 24*a* of the plates 24 of each leg 20 in order to move the shuttles 30 to the high position using the legs 20, as shown in FIG. 10.

During the movement of the legs 20 to lift the platform 60 using the shuttles 30, each shuttle 30 is guided by the columns 51, which slide in the passages 52.

These columns 51 also make it possible to keep the base plates 35 in a substantially horizontal position and to prevent the shuttles 30 from tilting under the weight of the platform 60 carrying the bridge crane 65.

The door 15 is opened and a vessel or a barge 5 carrying the underwater equipment 1 is brought between the lateral arms 11*a* of the hull 11 in order to place the underwater equipment 1 to be deposited on the sea bottom, underneath the anchoring means 70 carried by the platform 60.

Figure 12:
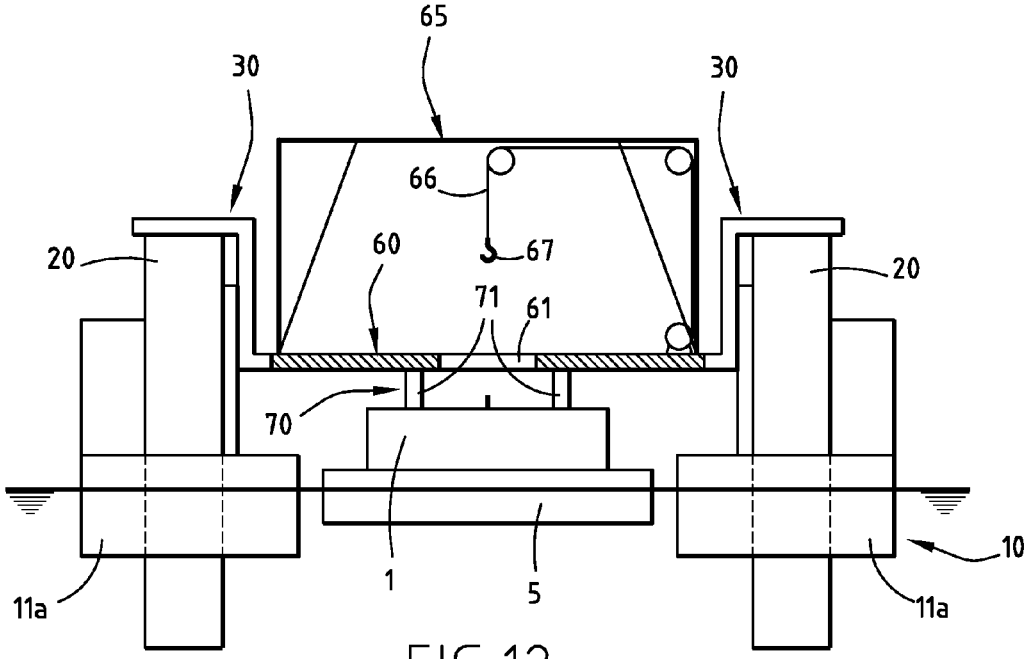
Figure 13:
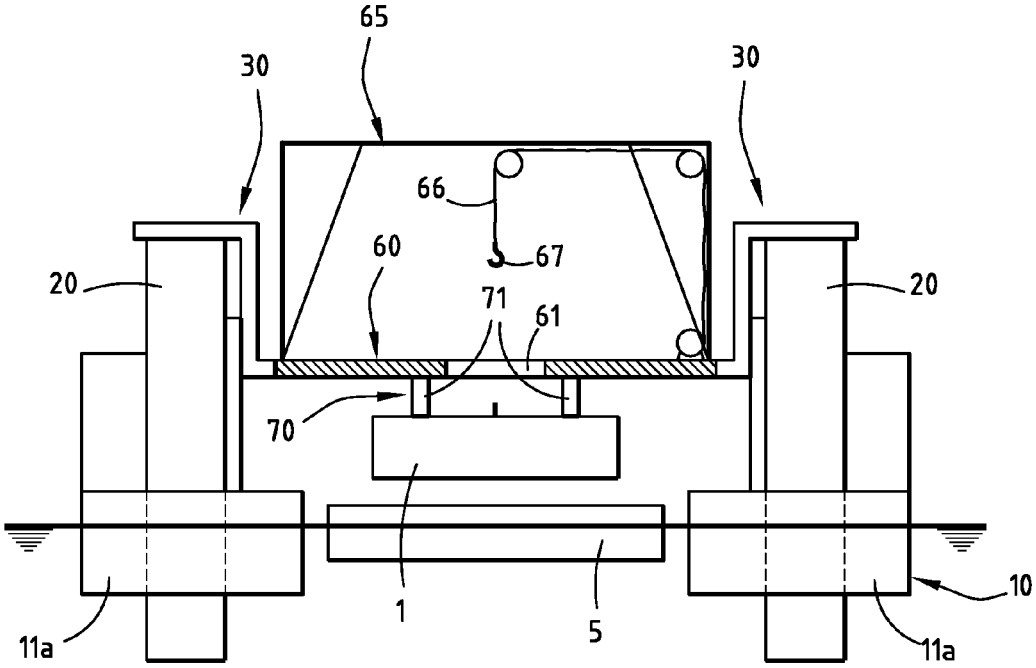
Figure 14:
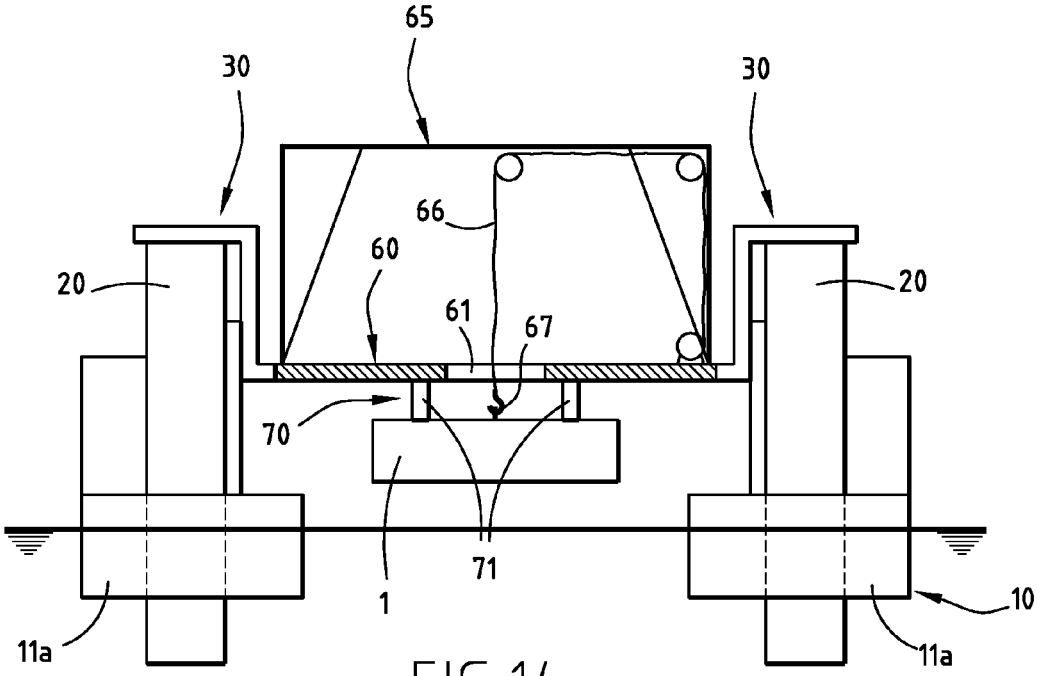

The shuttles 30 are lowered by legs 20 to secure the underwater equipment 1 to the anchoring means 70, as shown in FIGS. 8 and 12.

The cable 66 of the bridge crane 65 is connected via towing chains 75 and the chain 76 to the underwater equipment. The cable 66 is stretched and the protruding portions 2 of the equipment 1 come into contact with the flexible material of the hollow portion 72 of the columns 71. The locking means 76*a* of the "stop chain" type carried on the upper face 60*b* of the platform 60 are engaged in the links of the chain 76. The cable 66 is then relaxed and the weight of the equipment 1 is then picked up only by the locking element 76*a* of the chain 76 and the chain itself. The crushing of the elastomer makes it possible to correctly position the chain 76 links relative to the locking element 76*a*.

The structure 10 is moved to the placement site of the equipment 1 on the sea bottom.

Figure 15:
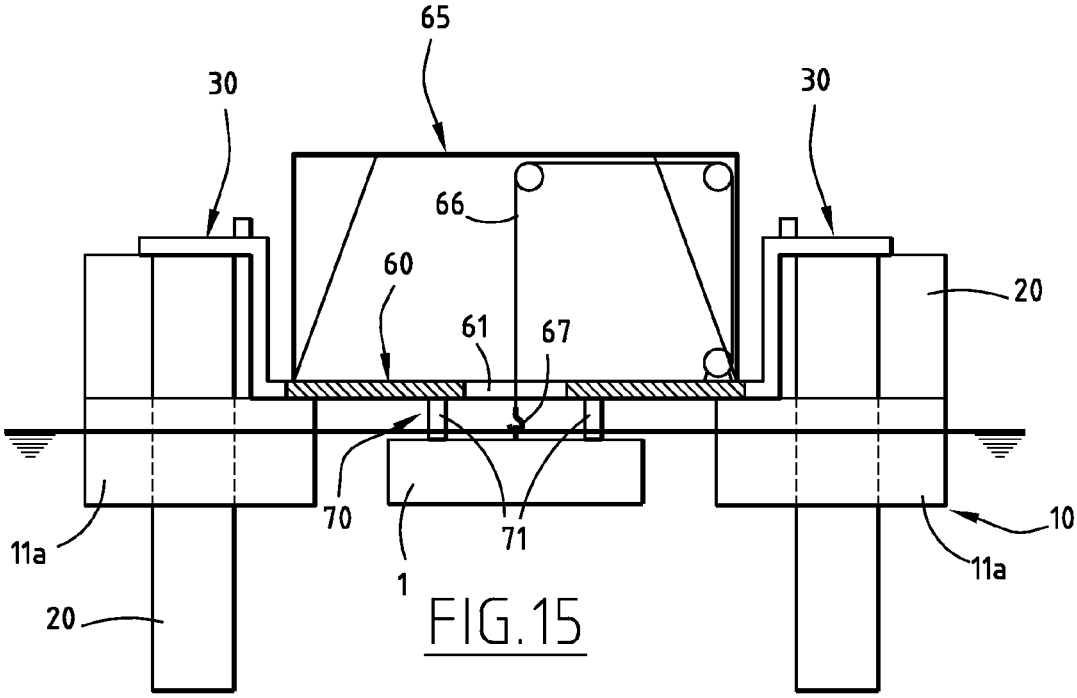
Figure 16:
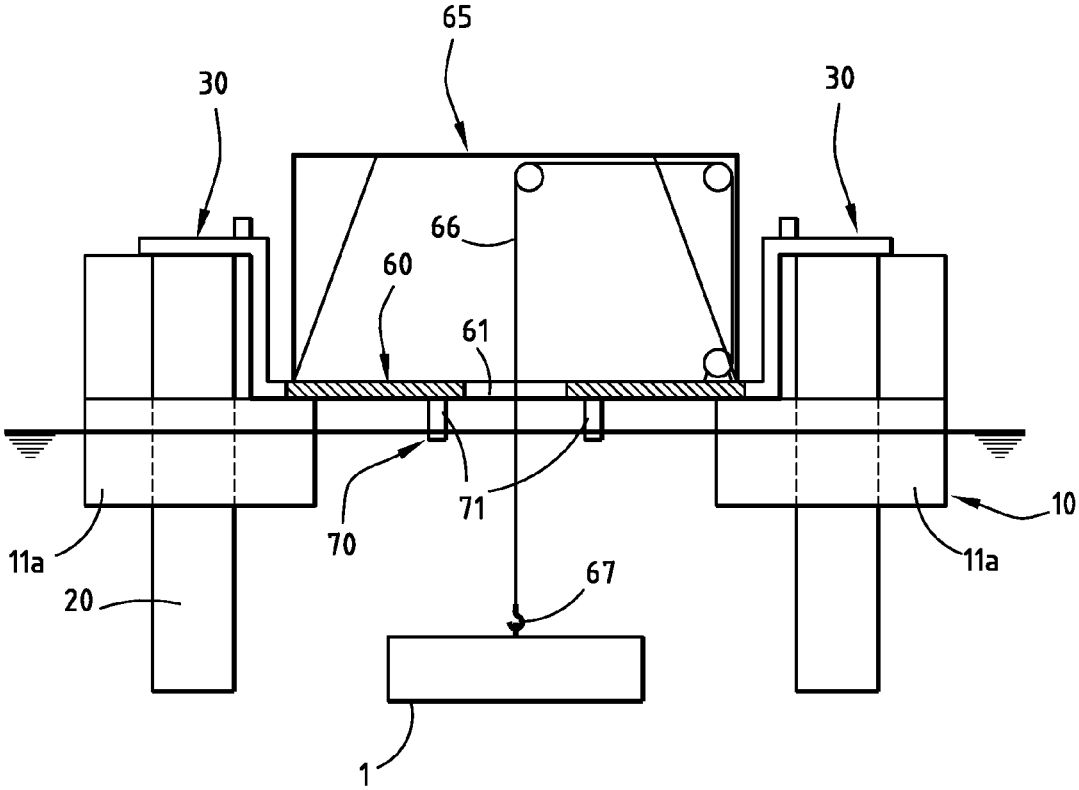

The shuttles 30 are lowered by the legs 20 to place the underwater equipment 1 below the water level, as shown in FIG. 15. This underwater equipment 1 is unlocked from the platform 60 and is gradually lowered to the sea bottom by the cable 66 of the bridge crane 65, as shown in FIG. 16.

After placement of the underwater equipment 1 on the sea bottom, the cable 66 is disconnected from said underwater equipment 1, then is raised.

The structure 10 can be used to transport and install other underwater equipment.

The structure 10 can also be used to retrieve and transport underwater equipment before placement on the sea bottom.

The structure 10 is moved to the retrieval site of the underwater equipment 1 placed on the sea bottom, and the platform 60 is lowered by legs 20 and shuttles 30 locked on said legs 20 so as to bring the anchoring means 70 below the water level.

The cable 66 of the bridge crane 65 is lowered in the water and connected to the underwater equipment 1. The underwater equipment 1 is raised to the anchoring means 70 that have been placed in the water beforehand.

The underwater equipment 1 is locked on the anchoring means 70 and the platform 60 carrying said underwater equipment 1 is raised by legs 20 and shuttles 30 so as to bring the underwater equipment 1 above the water level.

The structure 10 is moved to a transport vessel or barge and the underwater equipment carried by the platform 60 is positioned above said vessel or barge. The platform 60 is lowered by legs 20 and shuttles 30 to place the underwater equipment 1 on the vessel or barge.

The anchoring means 70 and the cable 66 of the bridge crane 65 are disconnected from the underwater equipment 1 and the shuttles 30 and the platform 60 are raised by legs 20. The vessel or barge carrying the underwater equipment 1 is discharged from the structure 10.

The structure 10 can receive platforms with different dimensions due to the adjustment of the spacing of the lateral branches 11*a* of the hull 11.

Figure 17:
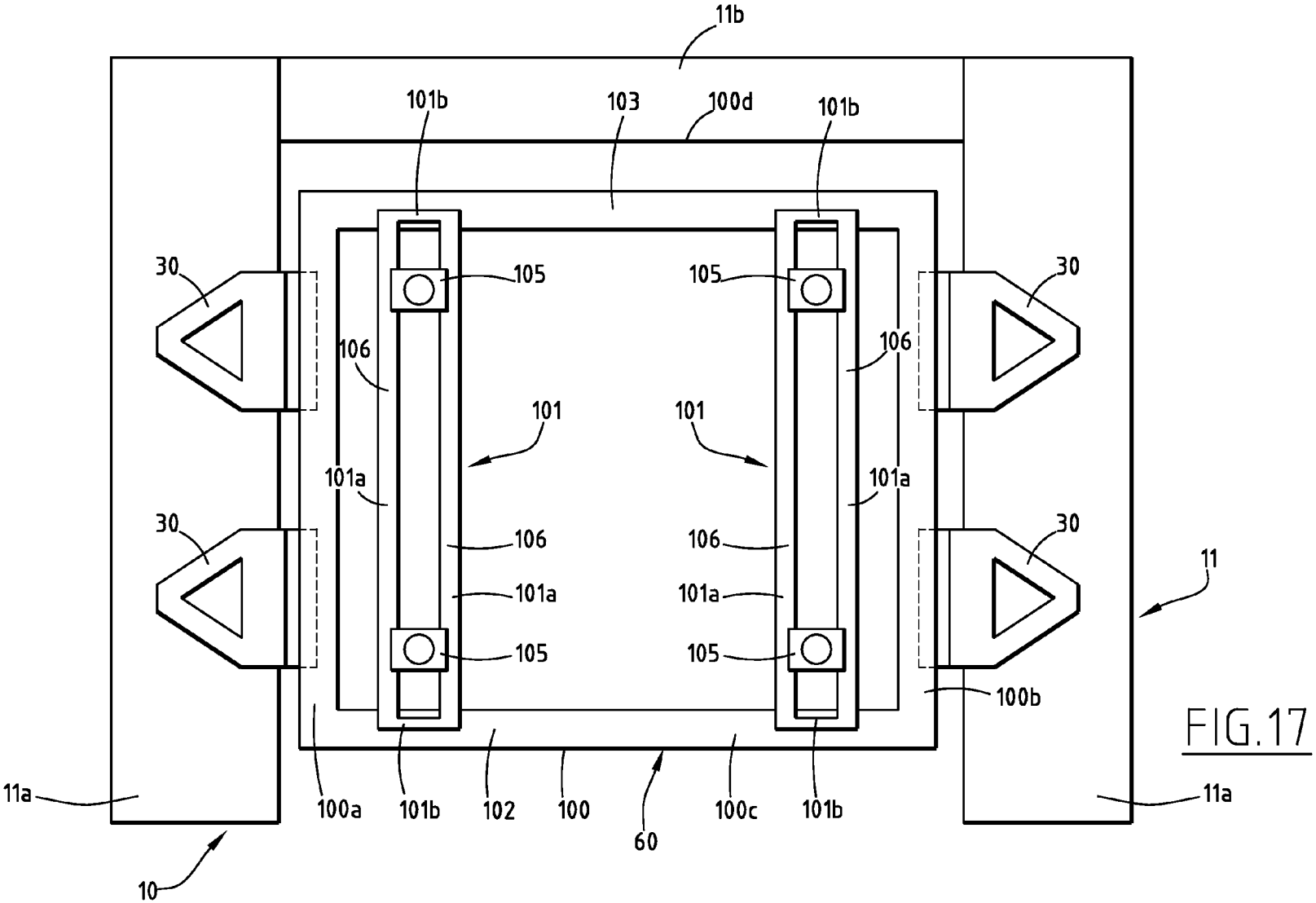
FIG. 17 is a diagrammatic top view of an alternative of the platform carried by the shuttles.
Figure 18:
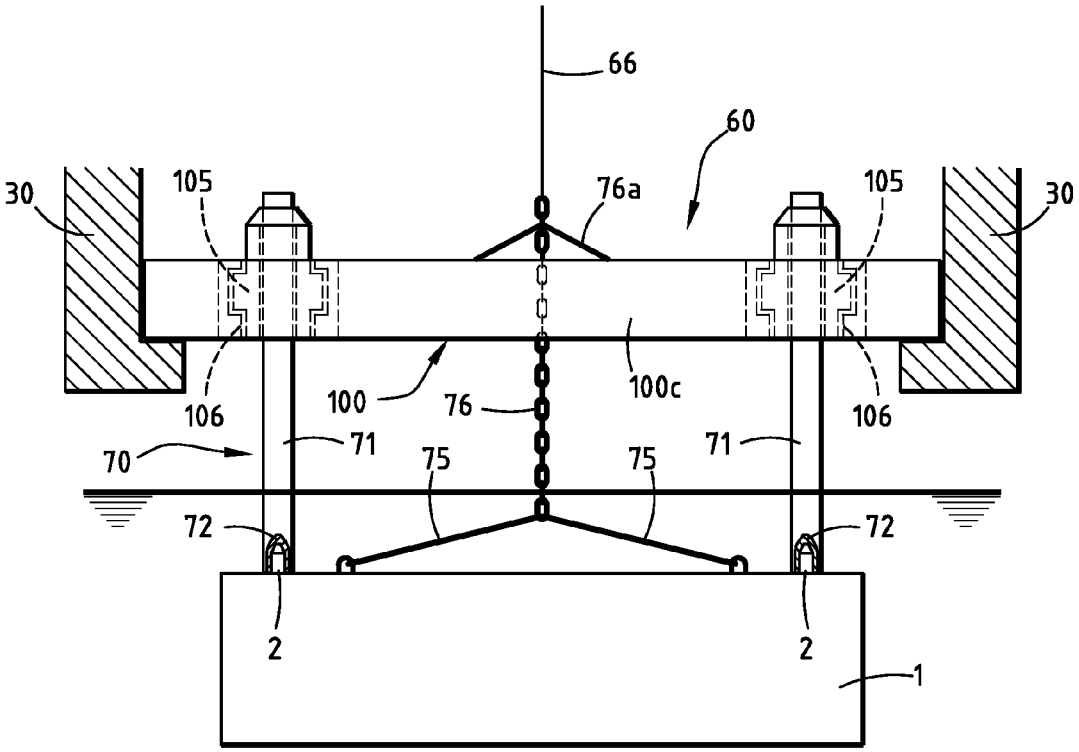
FIG. 18 is a diagrammatic side view of the platform of FIG. 17 with the underwater equipment.

According to one preferred embodiment illustrated in FIGS. 17 and 18, the platform 60 is made up of a frame 100. This frame 100 comprises two sides 100*a* and 100*b* that are parallel to each other and rest on the shuttles 30. These two sides 100*a* and 100*b* are connected to each other by two transverse sides 100*c* and 100*d*, the whole forming the platform 60. This frame 100 also includes two beams 101 mounted so as to slide along the two transverse sides 100*c* and 100*d* and moving in a direction perpendicular to the other two sides 100*a* and 100*b*.

Each beam 101 is in the shape of a frame comprising two longitudinal sides 101*a* parallel to the sides 100*a* and 100*b* of the frame 100. The longitudinal sides 101*a* of each beam 101 are connected to each other by two transverse sides 101*b*, one of the two transverse sides 101*b* mounted sliding in a channel, 102, formed in the transverse side 100*c*, and the other one of the two transverse sides 101*b* sliding in a channel 103, formed in the transverse side 100*d*, respectively. Thus, each beam 101 can slide perpendicular to the longitudinal axis of the hull 11 of the structure 10.

Each beam 101 carries at least one column 71 and, in the embodiment shown in FIG. 17, two columns 71. Each column 71 is mounted sliding along and inside the corresponding beam 101. To that end, each column 71 is supported by an element 105 mounted sliding in a channel 106 formed in the longitudinal sides 101*a* of each beam 101. Each column 71 can therefore be moved along the channel 106 parallel to the longitudinal axis of the hull 11 of the structure 10.

Thus, the spacing between the two columns 71 of each beam 101 can be adjusted. Each support element 105 for supporting a column 71 includes a locking means, not shown, either by gripping, or using at least one pin to secure the corresponding column 71 to the element 105.

In this embodiment, the transverse spacing, i.e. perpendicular to the longitudinal axis of the hull 11 between the two pairs of columns 71, can be adjusted and the longitudinal spacing, i.e. parallel to the longitudinal axis of the hull 11 between the two columns of each pair of columns, can also be adjusted, which makes it possible to be able to adjust the position of the columns as a function of the dimensions of the underwater equipment 1 to be transported and installed.

Moreover, the height of the columns relative to the platform can also be adjusted so as to ensure that the equipment is placed below the surface of the water when the shuttles and the platform are in the low position.

The structure according to the invention allows the transport and installation or retrieval of underwater equipment while avoiding transporting said underwater equipment under the water level, as well as the suspension of said underwater equipment using a flexible element, such as a cable or a chain, for example, when it enters the water, i.e. when it passes below the surface of the water.

The invention claimed is:

1. A structure for transporting and installing or retrieving underwater equipment comprising:

a floating hull equipped with legs that can be moved vertically relative to the floating hull using movement mechanisms, a platform carried by shuttles, each shuttle being associated with a respective one of said legs, said platform being configured to be moved vertically relative to the hull by said legs, each shuttle being provided with means for locking on the respective one of said legs, each shuttle being configured to be locked on the respective one of said legs and said hull being configured to remain buoyant while said platform is moved relative to said hull, means of temporarily anchoring the equipment to the underside of the platform, and means of moving said equipment in the water between a first position pressed against the anchoring means and a second position away from the anchoring means;

wherein the floating hull is U-shaped, the U-shaped floating hull has two opposite and parallel lateral arms, each carrying at least one leg and connected to each other by a central arm, and the two lateral arms are formed by two floats and the central arm is formed by a cross-beam carried by said lateral arms, said lateral arms being slidingly movable on said cross-beam depending on the length of the platform carried by the shuttles.

2. The structure according to claim 1, wherein the movement means in the water comprise a bridge crane supported by the platform, the bridge crane having at least one support cable, passing through said platform through an opening in said platform, and provided, at its free end, with a hooking member for hooking on said equipment.

3. The structure according to claim 2, wherein the temporary anchoring means comprise at least two vertical columns, carried by the platform and provided at their lower ends with positioning means for positioning said equipment, and tensioning and hooking means for said at least one support cable of the bridge crane.

4. The structure according to claim 3, wherein the positioning means comprise a hollow portion with a substantially conical shape, arranged at the lower portion of each column, and substantially conical protruding portions, arranged on the equipment and each intended to cooperate with each said respective hollow portion.

5. The structure according to claim 4, wherein each hollow portion is covered with a flexible material, such as an elastomer.

6. The structure according to claim 3, wherein a vertical positioning of each of said at least two vertical columns relative to the platform can be adjusted.

7. The structure according to claim 1, wherein the temporary anchoring means comprise at least one clamp or at least one jaw or at least one explosive bolt.

8. A structure for transporting and installing or retrieving underwater equipment comprising:

a floating hull equipped with legs that can be moved vertically relative to the floating hull using movement mechanisms, a platform carried by shuttles, each shuttle being associated with a respective one of said legs, said platform being configured to be moved vertically relative to the hull by said legs, each shuttle being provided with means for locking on the respective one of said legs, means of temporarily anchoring the equipment to the underside of the platform, and means of moving said equipment in the water between a first position pressed against the anchoring means and a second position away from the anchoring means, wherein the movement means in the water comprise a bridge crane supported by the platform, the bridge crane having at least one support cable, passing through said platform through an opening in said platform, and provided, at its free end, with a hooking member for hooking on said equipment, the temporary anchoring means comprise at least two vertical columns, carried by the platform and provided at their lower ends with positioning means for positioning said equipment, and tensioning and hooking means for said at least one support cable of the bridge crane, and the tensioning and hooking means comprise at least two towing chains including a first end connected to the equipment and a second end connected to said at least one support cable of the bridge crane by a chain capable of cooperating with a locking element tensioned on the platform.

9. A structure for transporting and installing or retrieving underwater equipment comprising:

a floating hull equipped with legs that can be moved vertically relative to the floating hull using movement mechanisms, a platform carried by shuttles, each shuttle being associated with a respective one of said legs, said platform being configured to be moved vertically relative to the hull by said legs, each shuttle being provided with means for locking on the respective one of said legs, means of temporarily anchoring the equipment to the underside of the platform, and means of moving said equipment in the water between a first position pressed against the anchoring means and a second position away from the anchoring means, wherein the movement means in the water comprise a bridge crane supported by the platform, the bridge crane having at least one support cable, passing through said platform through an opening in said platform, and provided, at its free end, with a hooking member for hooking on said equipment, the temporary anchoring means comprise at least two vertical columns, carried by the platform and provided at their lower ends with positioning means for positioning said equipment, and tensioning and hooking means for said at least one support cable of the bridge crane, and said at least two vertical columns can be slidingly moved below the platform in a direction parallel to the lateral arms of the hull.

10. The structure according claim 9, wherein the platform includes means for adjusting the spacing of said at least two vertical columns in a direction parallel to a longitudinal axis of the hull and in a direction perpendicular to said longitudinal axis.

11. A method for transporting and installing underwater equipment using a structure for transporting and installing or retrieving underwater equipment comprising:

a floating hull equipped with legs that can be moved vertically relative to the floating hull using movement mechanisms, a platform carried by shuttles, each shuttle being associated with a respective one of said legs, said platform being configured to be moved vertically relative to the hull by said legs, each shuttle being provided with means for locking on the respective one of said legs, each shuttle being configured to be locked on the respective one of said legs and said hull being configured to remain buoyant while said platform is moved relative to said hull, means of temporarily anchoring the equipment to the underside of the platform, and means of moving said equipment in the water between a first position pressed against the anchoring means and a second position away from the anchoring means, the method comprising the following steps:

bringing the underwater equipment near the hull of the structure by a floating transport element, lowering the legs relative to the hull, locking the shuttles carrying the platform on the legs, raising the legs with the shuttles and the platform, placing the platform above the underwater equipment, lowering the shuttles and the platform by the legs to bring the anchoring means into contact with the underwater equipment, locking the anchoring means to the underwater equipment, raising the shuttles and the platform carrying the underwater equipment by the legs, moving the structure to the installation site of the underwater equipment with said equipment above the water level, connecting the cable of the bridge crane to the underwater equipment, lowering the shuttles and the platform by the legs until the underwater equipment passes under the water level, tensioning the cable of the bridge crane, unlocking the anchoring means from the underwater equipment, and lowering the underwater equipment with the bridge crane cable to the sea bottom and disconnecting and raising the cable.

12. A method for retrieving and transporting underwater equipment using a structure for transporting and installing or retrieving underwater equipment comprising:

a floating hull equipped with legs that can be moved vertically relative to the floating hull using movement mechanisms, a platform carried by shuttles, each shuttle being associated with a respective one of said legs, said platform being configured to be moved vertically relative to the hull by said legs, each shuttle being provided with means for locking on the respective one of said legs, each shuttle being configured to be locked on the respective one of said legs and said hull being configured to remain buoyant while said platform is moved relative to said hull, means of temporarily anchoring the equipment to the underside of the platform, and means of moving said equipment in the water between a first position pressed against the anchoring means and a second position away from the anchoring means, the method comprising the following steps:

moving the structure to the retrieval site of the equipment placed on the sea bottom, lowering the shuttles locked on said legs and the platform by the legs to bring the anchoring means below the water level, lowering the cable of the bridge crane into the water and connecting said cable to the underwater equipment, raising the equipment by the cable up to the anchoring means in the water, locking the anchoring means to the underwater equipment, raising the legs with the shuttles and the platform carrying the underwater equipment, to place said underwater equipment above the water level, moving the structure to a transport element and placing the underwater equipment above the transport element, lowering the shuttles and the platform carrying the underwater equipment by the legs, placing the underwater equipment on the transport element by lowering the legs, disconnecting the cable from the underwater equipment, raising the shuttles and the platform by the legs, and discharging the transport element carrying the underwater equipment from the structure.

* * * * *

UNITED STATES PATENT AND TRADEMARK OFFICE

CERTIFICATE OF CORRECTION

PATENT NO. : 8,678,733 B2
APPLICATION NO. : 12/997275
DATED : March 25, 2014
INVENTOR(S) : Thomas et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 524 days.

Signed and Sealed this
Twenty-ninth Day of September, 2015

Michelle K. Lee

Michelle K. Lee
*Director of the United States Patent and Trademark Office*